US009644925B1

(12) United States Patent
Hollis et al.

(10) Patent No.: US 9,644,925 B1
(45) Date of Patent: May 9, 2017

(54) EXPLOSIVE DEVICE FOR BREACHING DOORS AND WALLS

(71) Applicants: Michael Hollis, Flanders, NJ (US); Ryan Gorman, Mountain Lakes, NJ (US); Stephen Recchia, Flanders, NJ (US); Gary Dundon, Rockaway, NJ (US)

(72) Inventors: Michael Hollis, Flanders, NJ (US); Ryan Gorman, Mountain Lakes, NJ (US); Stephen Recchia, Flanders, NJ (US); Gary Dundon, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 391 days.

(21) Appl. No.: 14/309,222

(22) Filed: Jun. 19, 2014

(51) Int. Cl.
*F42B 1/028* (2006.01)
*F42D 3/00* (2006.01)
*F42B 1/036* (2006.01)

(52) U.S. Cl.
CPC ..... *F42B 1/028* (2013.01); *F42B 1/036* (2013.01); *F42D 3/00* (2013.01)

(58) Field of Classification Search
CPC .. F42B 1/02; F42B 1/028; F42B 1/032; F42B 1/036; F42B 3/08; F42B 5/045
USPC ..... 102/305, 306, 307, 308, 309, 310, 475, 102/476; 89/1.15, 151; 86/50
See application file for complete search history.

(56) References Cited

U.S. PATENT DOCUMENTS 2,892,407 A * 6/1959 MacLeod ..... F42B 1/024 102/309
3,016,830 A * 1/1962 Kirby, II ..... E21B 29/02 102/306
3,282,354 A * 11/1966 Hakala ..... E21B 43/117 166/55
4,681,171 A 7/1987 Kee
4,694,754 A * 9/1987 Dines ..... F42B 3/08 102/310
4,803,928 A * 2/1989 Kramer ..... F42B 12/16 102/306
4,860,654 A * 8/1989 Chawla ..... E21B 43/117 102/306

(Continued)

FOREIGN PATENT DOCUMENTS

DE EP 0178486 A1 * 4/1986 ..... F42B 1/02
DE 3737231 A1 * 5/1989 ..... F42B 1/02

*Primary Examiner* — Bret Hayes
(74) *Attorney, Agent, or Firm* — John P. DiScala

(57) ABSTRACT

An explosive breaching device is made from a surplus bomblet. The bomblet includes a shaped-charge liner, a steel fragmentation case with an open end, explosive material disposed between the shaped-charge liner and the steel fragmentation case, and a fuze. The fuze of the bomblet is removed and a shock-attenuating case is fixed adjacent to and coaxial with the steel fragmentation case. The shock-attenuating case may be made of a material having a speed of sound that differs from the speed of sound in the steel fragmentation case. A mild steel housing is fixed around the shock-attenuating case. A retaining sleeve may be fixed to the mild steel housing. The explosive breaching device may be mounted in an aiming device to direct the shaped-charge jet in a desired direction.

11 Claims, 5 Drawing Sheets

(56) References Cited

U.S. PATENT DOCUMENTS

| | | | | | |
|---|---|---|---|---|---|
| 4,974,516 | A * | 12/1990 | Eyal | F42B 12/28 | 102/476 |
| H1504 | H * | 12/1995 | Crabtree | F42B 1/02 | 102/476 |
| 5,616,885 | A * | 4/1997 | Walters | F42B 1/02 | 102/306 |
| 5,792,977 | A * | 8/1998 | Chawla | F42B 1/032 | 102/307 |
| 5,847,312 | A * | 12/1998 | Walters | F42B 1/02 | 102/307 |
| 6,386,109 | B1 * | 5/2002 | Brooks | E21B 43/117 | 102/306 |
| 6,393,991 | B1 * | 5/2002 | Funston | F42B 1/028 | 102/306 |
| 6,408,765 | B1 | 6/2002 | Tauber | | |
| 6,453,788 | B1 * | 9/2002 | Lebet | F42B 1/02 | 102/306 |
| 6,606,950 | B1 * | 8/2003 | Putman | F41H 11/12 | 102/306 |
| 8,220,395 | B1 * | 7/2012 | Gorman | F42B 1/02 | 102/482 |
| 8,272,328 | B1 | 9/2012 | Gorman | | |
| 8,677,902 | B1 * | 3/2014 | Rock | F42B 1/028 | 102/306 |
| 2004/0035313 | A1 * | 2/2004 | Ronn | F42B 12/18 | 102/476 |
| 2005/0081706 | A1 * | 4/2005 | Alford | F42B 33/062 | 89/1.13 |
| 2007/0119327 | A1 * | 5/2007 | Myers | F42B 1/02 | 102/306 |
| 2012/0216698 | A1 | 8/2012 | Van Stratum | | |
| 2013/0340599 | A1 * | 12/2013 | Parrott | E21B 43/117 | 89/1.15 |

* cited by examiner

EXPLOSIVE DEVICE FOR BREACHING DOORS AND WALLS

STATEMENT OF GOVERNMENT INTEREST

The inventions described herein may be manufactured, used and licensed by or for the United States Government.

BACKGROUND OF THE INVENTION

The invention relates in general to breaching devices and in particular to breaching devices for doors and walls.

Door breaching devices are used by, for example, police and fire departments and military and paramilitary organizations. One example of a door breaching device is a battering ram. A battering ram may not be adequate for doors of sturdy construction. Another door breaching device is a cutting torch. A cutting torch may require too much time to breach a door. In some situations, stealth and surprise is needed when breaching a door. Doors can be breached by placing small amounts of explosives on the door hinges and/or the door locking mechanism. In some cases explosives can be difficult to control.

U.S. Pat. No. 4,681,171 issued on Jul. 21, 1987 discloses a battering ram. U.S. Pat. No. 6,408,765 issued on Jun. 25, 2002 discloses a door breaching device with a safety adapter. U.S. Patent Application Publication 20120216698 published on Aug. 30, 2012 discloses a low shrapnel door breaching projectile.

The U.S. Army possesses a surplus of bomblets. If the surplus bomblets are destroyed, the large original capital investment will be lost. A method of converting a surplus bomblet into a hand grenade is disclosed in U.S. Pat. No. 8,272,328 issued on Sep. 25, 2012. A need exists for a cost effective method of converting the surplus bomblets into other useful products, such as door or wall breaching devices.

SUMMARY OF INVENTION

One aspect of the invention is an explosive breaching device with a central longitudinal axis. A generally cylindrical, steel fragmentation case having an open end is centered on the central longitudinal axis. A conical shaped-charge liner is disposed in the steel fragmentation case and defines a generally conical empty volume centered on the central longitudinal axis. Explosive material is disposed in the steel fragmentation case contiguous with a surface of the conical liner that is opposite the generally conical empty volume.

A shock-attenuating case is disposed adjacent to and coaxial with the steel fragmentation case. The shock-attenuating case may be made of a material having a speed of sound that differs from a speed of sound in the steel fragmentation case. The shock-attenuating case has an open end at a same end as the steel fragmentation case. A mild steel housing surrounds, is coaxial with and is generally contiguous with the shock-attenuating case. The mild steel housing has an open end at a same end as the steel fragmentation case.

A bore is formed in base portions of the steel fragmentation case, the shock-attenuating case and the mild steel housing distal their respective open ends. The bore is coaxial with the central longitudinal axis. An explosive train is disposed in the bore for detonating the explosive in the steel fragmentation case.

The shock-attenuating case may include a side portion in the shape of a sleeve. The side portion has a plurality of through holes formed therein. The central longitudinal axis of each through hole is parallel to the central longitudinal axis of the explosive breaching device. The base portion of the shock-attenuating case may be in the shape of a disc. The base portion includes a plurality of through holes formed therein. The central longitudinal axis of each through hole in the base portion lies in a plane that is normal to the central longitudinal axis of the explosive breaching device.

A retaining sleeve may be concentrically fixed to the mild steel housing. The retaining sleeve may include a first pair of pins on one side of the retaining sleeve and a second pair of pins on an opposite side of the retaining sleeve.

The explosive breaching device may include an aiming device. The aiming device includes a pair of opposed planar sides with an arcuate pin slot and a pin opening formed in each opposed side. The first pair of pins of the retaining sleeve are disposed in the arcuate pin slot and the pin opening on one of the opposed sides of the aiming device and the second pair of pins are disposed in the arcuate pin slot and the pin opening on the other of the opposed sides of the aiming device.

Another aspect of the invention is a method of converting a bomblet into an explosive breaching device. The method includes providing a bomblet having a fuze, a shaped-charge liner, a steel fragmentation case with an open end, and explosive material disposed between the shaped-charge liner and the steel fragmentation case. The fuze is removed from the bomblet. A shock-attenuating case is attached adjacent to and coaxial with the steel fragmentation case. The shock-attenuating case may be made of a material having a speed of sound that differs from a speed of sound in the steel fragmentation case. A mild steel housing is attached around the shock-attenuating case. A second explosive material may be placed in a central bore formed in the mild steel housing.

The method may include concentrically fixing a retaining sleeve to the mild steel housing. The explosive breaching device may be mounted in an aiming device.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A known Dual Purpose Improved Conventional Munition (DPICM) bomblet may be converted into an explosive breaching device for breaching, for example, doors or walls. The process of converting the known DPICM bomblet into a breaching device may be about 30 to 40% cheaper than purchasing a new breaching device.

Figure 1A:
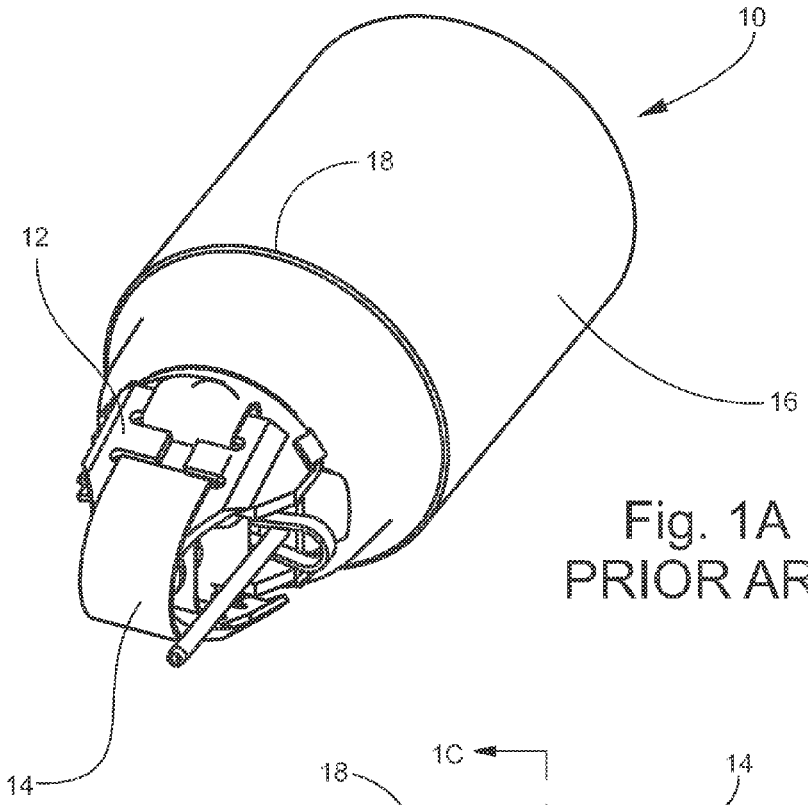
Fig. 1A PRIOR ART
FIG. 1A is a perspective view of a bomblet.
Figure 1B:
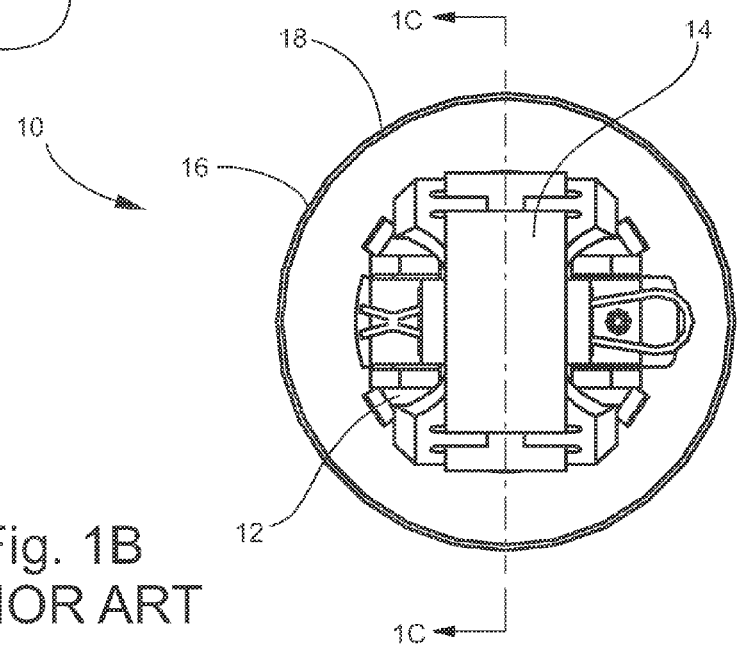
Fig. 1B PRIOR ART
FIG. 1B is a top view of the bomblet of FIG. 1A.
Figure 1C:
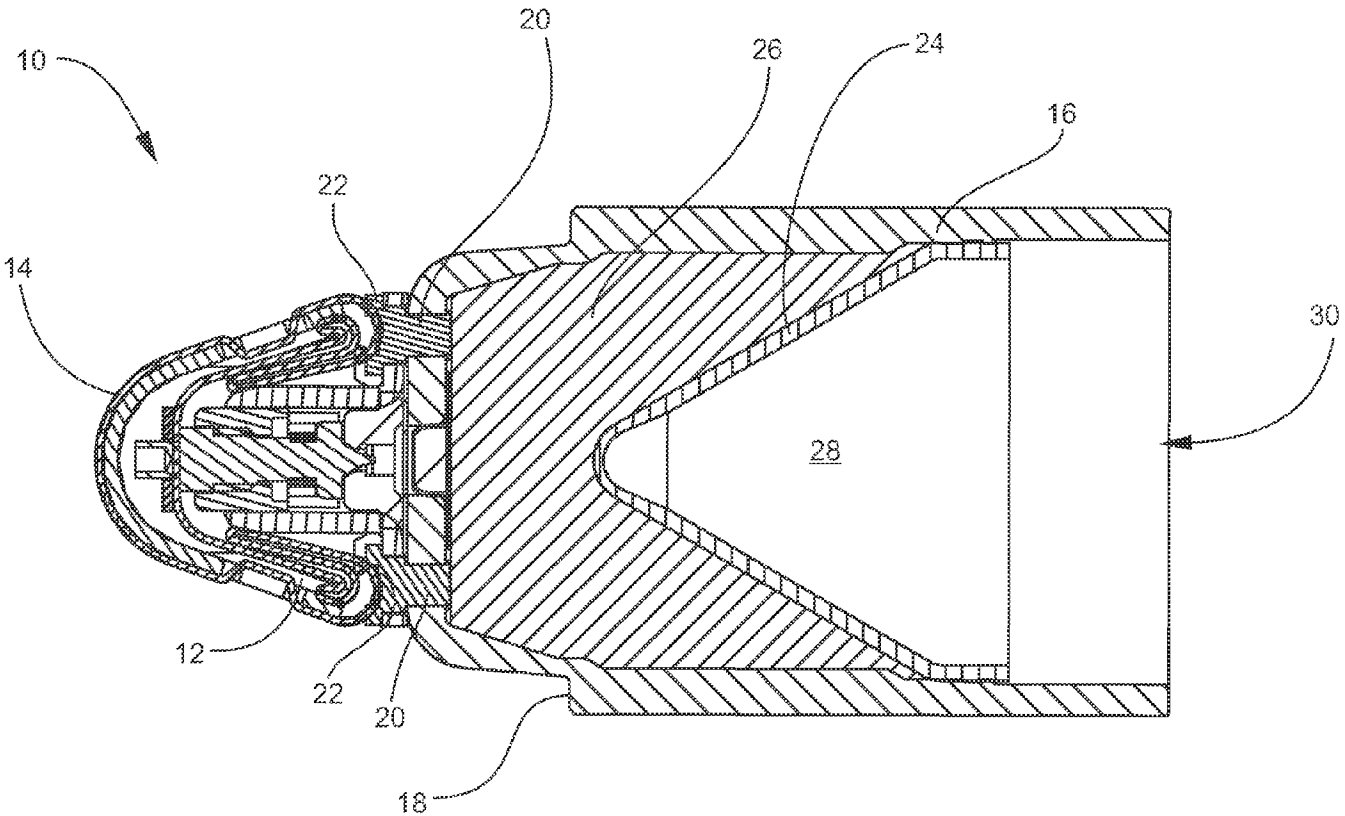
Fig. 1C PRIOR ART
FIG. 1C is a sectional view taken along the line 1C-1C of FIG. 1B.

FIGS. 1A-C show an embodiment of a known DPICM bomblet 10. Bomblet 10 includes a fuze 12 staked thereon. Fuze 12 may be, for example, an M223 fuze. Studs 20 (FIG. 1C) are used to stake fuze 12 to bomblet 10. Fuze 12 includes a ribbon stabilizer 14. Bomblet 10 includes a generally cylindrical steel fragmentation case 16 having an external shoulder 18 and an open end 30. Explosive material 26 (FIG. 1C) is disposed between case 16 and a conical shaped-charge liner 24. The exterior surface of liner 24 defines a generally conical empty volume 28.

Bomblet 10 may be converted to an explosive breaching device. A method of converting bomblet 10 includes removing fuze 12 from bomblet 10. Fuze 12 may be removed from bomblet 10 by, for example, milling staked material 22 and lifting fuze 12 from bomblet 10. The remainder of the bomblet 10, that is, the steel case 16, liner 24 and explosive material 26 may be used to make an explosive breaching device.

Figure 2:
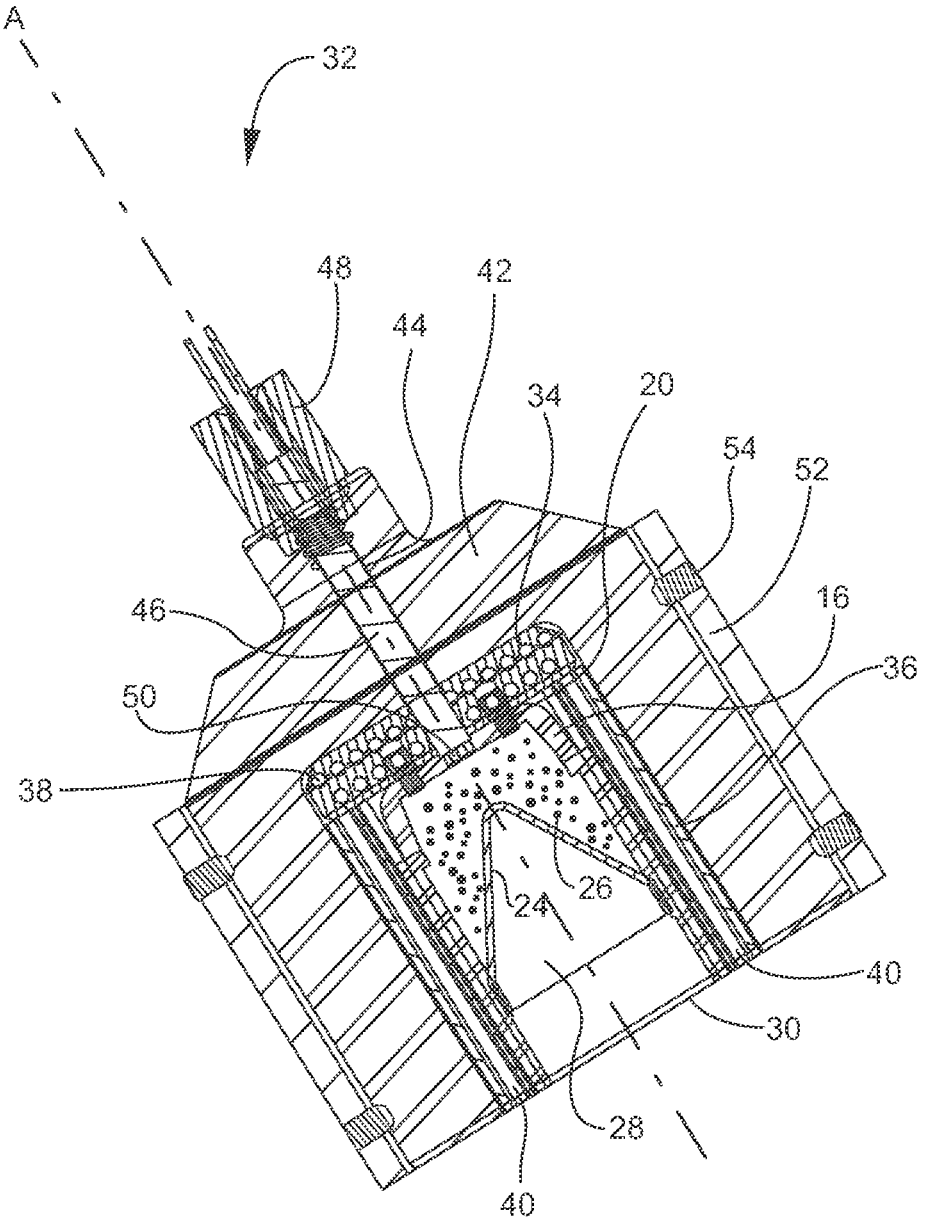
FIG. 2 is a sectional view of one embodiment of an explosive breaching device.

FIG. 2 is a sectional view of one embodiment of an explosive breaching device 32 formed from bomblet 10. Device 32 has a central longitudinal axis A. Steel fragmentation case 16 is centered on axis A, as is conical shaped-charge liner 24.

In device 32, a generally cylindrical, shock-attenuating case 34, 36 is disposed adjacent to and coaxial with the steel fragmentation case 16. Shock-attenuating case 34, 36 is made of a structure that yields or deforms and, therefore, absorbs the shock energy from explosive 26. Shock-attenuating case 34, 36 is preferably made of a material having a different speed of sound than steel fragmentation case 16. The purpose of shock-attenuating case 34, 36 is to absorb energy from the reaction of explosive material 26, thereby preventing the mild steel housing 42 from spalling and directing the explosive energy towards opening 30. The material of shock-attenuating case 34, 36 may be, for example, copper or aluminum. Case 34, 36 has an open end at the same end as end 30 of steel fragmentation case 16.

In the embodiment shown, the shock-attenuating case 34, 36 includes a base portion 34 and a side portion 36. Base portion 34 has the general shape of a disc and side portion 36 has the general shape of a cylindrical sleeve. Side portion 36 has a plurality of through holes 40 formed therein (see also FIGS. 3B and 3C). The central longitudinal axis of each through hole 40 preferably is parallel to axis A of the explosive breaching device 32. The base portion 34 has a plurality of through holes 38 formed therein. The central longitudinal axis of each through hole 38 in the base portion 34 preferably lies in a plane that is normal to the central longitudinal axis A of the explosive breaching device 32. The bottom of base portion 34 may also include openings or cavities (not shown) for receiving the top portions of studs 20.

A mild steel housing 42 surrounds, is coaxial with and is generally contiguous with the shock-attenuating housing 34, 36. The mild steel housing 42 has an open end at a same end as end 30 of the steel fragmentation case 16. The combination of the shock-attenuating housing 34, 36 and the mild steel housing 42 contains fragments formed by fragmentation case 16 and directs the energy of explosive material 26 toward opening 30. To prevent, for example, collateral damage, it may sometimes be desired to limit the distance traveled by the jet that is formed by the shape-charge liner 24. One way to limit the range of the jet formed by the liner 24 is to attach a plate of appropriate thickness (not shown), such as a metal plate, over open end 30. Then, when explosive material 26 reacts, the jet formed by the shaped-charge liner 24 will be forced to penetrate the plate fixed over end 30, thereby lessening the kinetic energy of the jet.

Shock-attenuating case 34, 36 and mild steel housing 42 may be fixed in place by various known means, such as threaded joints, epoxy, etc.

A central bore 44 is formed in the base portion of the steel fragmentation case 16, the base portion 34 of the shock-attenuating case 34, 36 and the base portion of the mild steel housing 42. Bore 44 is distal the respective open ends of steel fragmentation case 16, shock-attenuating case 34, 36 and mild steel housing 42. Bore 44 is coaxial with the central longitudinal axis A. An explosive train is disposed in bore 44 for detonating the explosive 26 in the steel fragmentation case 16. The explosive train may include lead 50 in bore 44 in fragmentation case 16 and a blasting cap 46 in bore 44 in mild steel housing 42. A primer adapter 48 may be fixed to a top of housing 42. Blasting cap 46 may be detonated by a variety of known means, including fuzes, electric ignition, timers, or remote control.

Figure 3A:
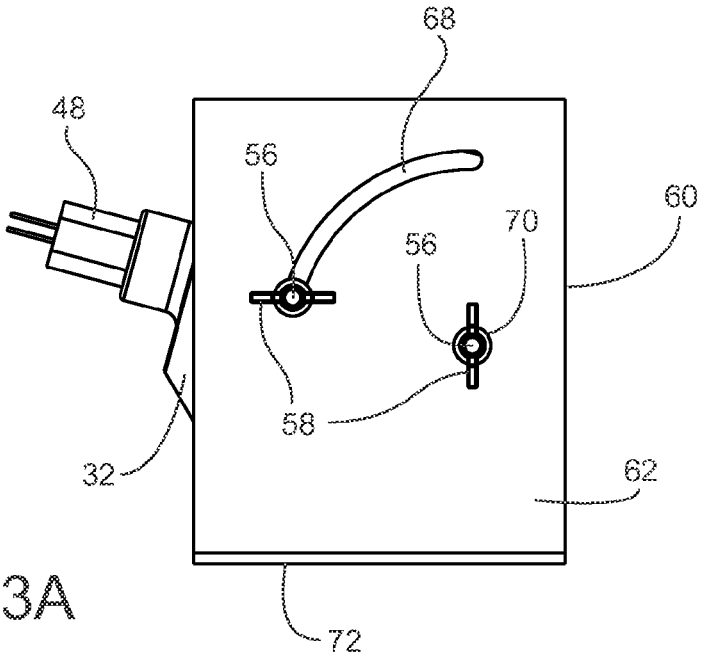
FIG. 3A is a side view of the explosive breaching device mounted in an aiming device.
Figure 3B:
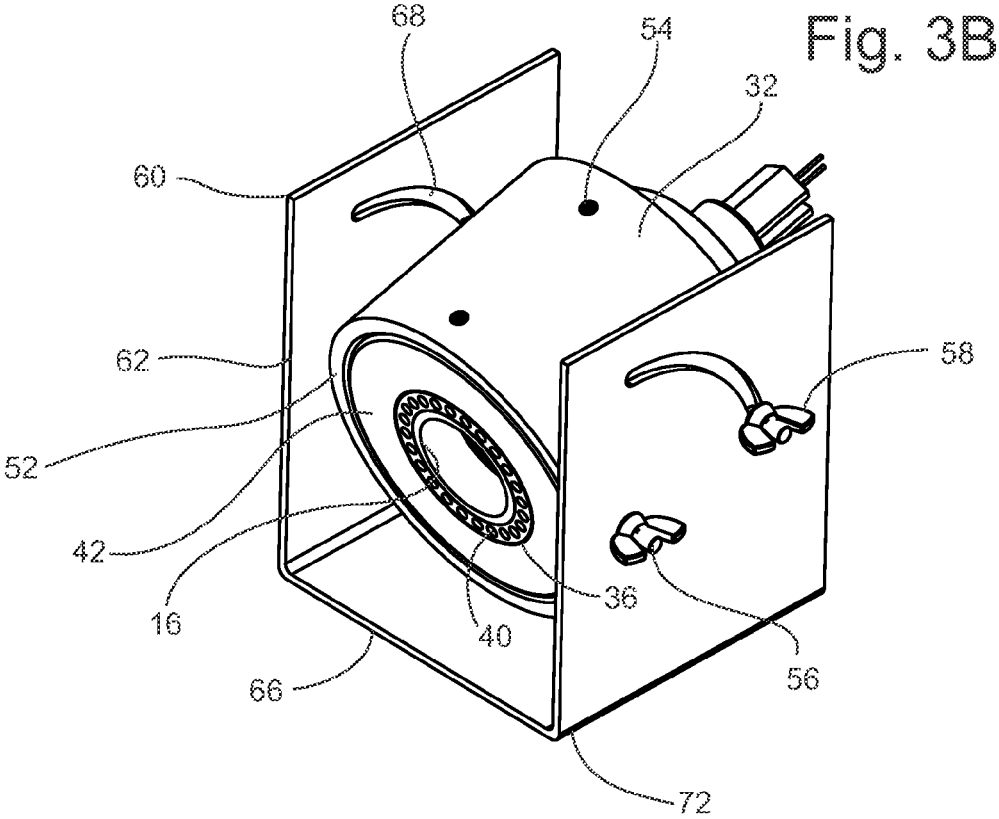
FIG. 3B is a perspective view of FIG. 3A.
Figure 3C:
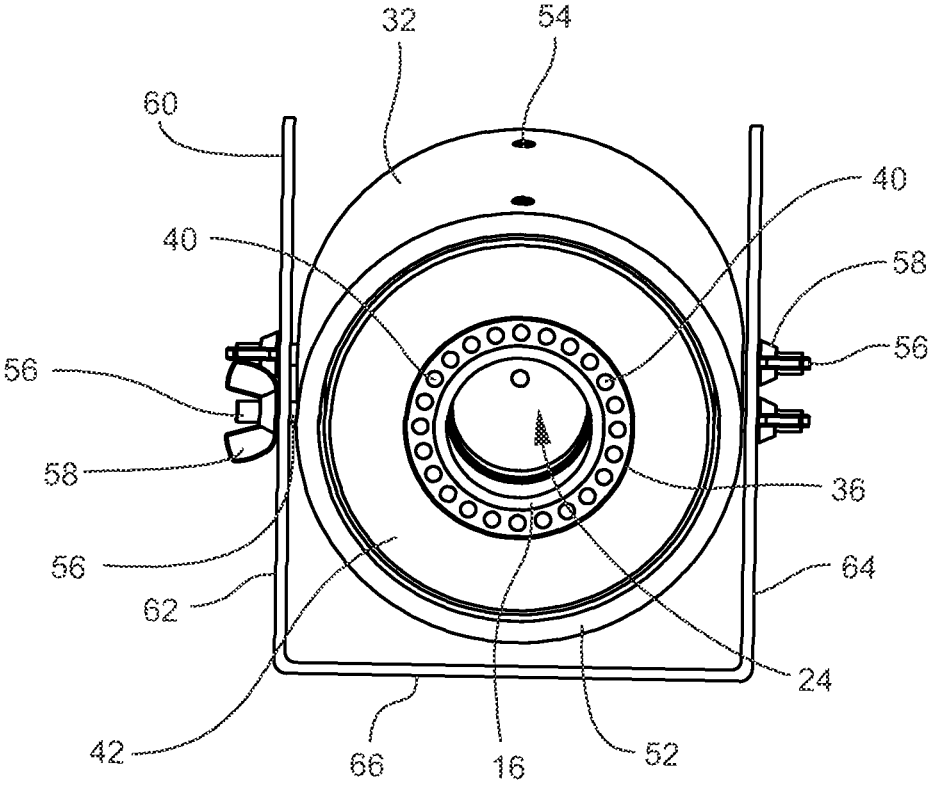
FIG. 3C is an end perspective view of FIG. 3A.

For some uses of device 32, it may be desirable to provide an aiming device to enable more accurate aiming of the shaped-charge liner 24. A retaining sleeve 52 may be concentrically fixed to the mild steel housing 42 by, for example, set screws 54. Referring to FIGS. 3A-C, retaining sleeve 52 may include two pairs of pins 56 disposed on opposite sides of sleeve 52. Pins 56 extend outwardly from retaining sleeve 52 and may be threaded to enable the use of threaded fasteners 58.

An aiming device 60, such as an aiming quadrant, includes a pair of opposed planar sides 62, 64 connected by a base 66. Each side 62, 64 may include an arcuate pin slot 68 and a pin opening 70 formed therein. One pair of pins 56 are disposed in the arcuate pin slot 68 and the pin opening 70 on one side 62 and the other pair of pins 56 are disposed in the arcuate pin slot 68 and the pin opening 70 on the other side 64. When fasteners 58 are loosened, pins 56 may be moved in arcuate slots 68 to aim the explosive device in a desired direction. Then, fasteners 58 are tightened to secure the aiming position of the explosive device.

If desired, base 66 of aiming device 60 may have a layer of double-sided tape 72 thereon. Tape 72 may be used to fix aiming device 60 to a surface, such as a door hinge, locking mechanism, wall, etc. Explosive device 32 may also be used as, for example, a self-destruct device to destroy equipment that stores or handles classified information.

While the invention has been described with reference to certain embodiments, numerous changes, alterations and modifications to the described embodiments are possible without departing from the spirit and scope of the invention as defined in the appended claims, and equivalents thereof.

What is claimed is:

1. An explosive breaching device with a central longitudinal axis, comprising:

a generally cylindrical, steel fragmentation case having an open end and centered on the central longitudinal axis;

a conical shape-charged liner disposed in the steel fragmentation case and defining a generally conical empty volume centered on the central longitudinal axis;

an explosive disposed in the steel fragmentation case contiguous with a surface of the conical liner that is opposite the generally conical empty volume;

a shock attenuating case disposed adjacent to and coaxial with the steel fragmentation case, the shock-attenuating case being made of a material having a speed of sound that differs from a speed of sound in the steel fragmentation case, the shock attenuating case having an open end at a same end as the steel fragmentation case;

a mild steel housing surrounding, coaxial with and generally contiguous with the shock-attenuating case, the mild steel housing have an open end at a same end as the steel fragmentation case;

a bore formed in base portions of each of the steel fragmentation case, the shock-attenuating case and the mild steel housing distal their respective open ends, the bore being coaxial with the central longitudinal axis;

an explosive train disposed in the bore for detonating the explosive in the steel fragmentation case; and wherein the shock-attenuating case includes a side portion in the shape of a sleeve, the side portion having a plurality of through holes formed therein wherein a central longitudinal axis of each through hole is parallel to the central longitudinal axis of the explosive breaching device.

2. The explosive breaching device of claim 1, wherein the base portion of the shock attenuating case is in the shape of a disc, the base portion including a plurality of through holes formed therein wherein a central longitudinal axis of each through hole in the base portion lies in a plane that is normal to the central longitudinal axis of the explosive breaching device.

3. The explosive breaching device of claim 2, wherein the base portion and the side portion of the shock-attenuating case are made of copper.

4. The explosive breaching device of claim 1 wherein the explosive train includes a blasting cap disposed in the bore.

5. The explosive breaching device of claim 1, further comprising a retaining sleeve concentrically fixed to the mild steel housing, the retaining sleeve including a first pair of pins on one side of the retaining sleeve and a second pair of pins on an opposite side of the retaining sleeve.

6. The explosive breaching device of claim 5, further comprising an aiming device, the aiming device including a pair of opposed planar sides with an arcuate pin slot and a pin opening formed in each opposed side, the first pair of pins being disposed in the arcuate pin slot and the pin opening on one of the opposed sides and the second pair of pins being disposed in the arcuate pin slot and the pin opening on the other of the opposed sides.

7. The explosive breaching device of claim 6, further comprising fasteners for fixing the first and second pairs of pins to the aiming device.

8. A method of converting a bomblet into an explosive breaching device, comprising:

providing the bomblet, the bomblet including a fuze, a shaped-charge liner, a steel fragmentation case with an open end, and explosive material disposed between the shaped-charge liner and the steel fragmentation case;

removing the fuze from the bomblet;

attaching a shock-attenuating case adjacent to and coaxial with the steel fragmentation case, the shock attenuating case being made of a material having a speed of sound that differs from a speed of sound in the steel fragmentation case, the shock-attenuating case having an open end at a same end as the steel fragmentation case;

attaching a mild steel housing around the shock-attenuating case, the mild steel housing having an open end at a same end as the steel fragmentation case;

concentrically fixing a retaining sleeve to the mild steel housing;

placing a second explosive material in a central bore formed in the mild steel housing; and wherein the retaining sleeve includes a first pair of pins on one side of the retaining sleeve and a second pair of pins on an opposite side of the retaining sleeve.

9. The method of claim 8 further comprising providing an aiming device and mounting the explosive breaching device in the aiming device.

10. The method of claim 8, wherein providing an aiming device includes providing an aiming device having a pair of opposed sides with an arcuate pin slot and a pin opening formed in each opposed side.

11. The method of claim 10, wherein mounting the explosive breaching device in the aiming device includes inserting the first pair of pins in the arcuate pin slot and the pin opening on one of the opposed sides and inserting the second pair of pins in the arcuate pin slot and the pin opening on the other of the opposed sides.

* * * * *